US009021971B2

(12) United States Patent
Escher

(10) Patent No.: US 9,021,971 B2
(45) **Date of Patent: *May 5, 2015**

(54) FLOATING VESSEL FOR SERVICING AIR DIFFUSERS

(71) Applicant: Fred Francis Escher, Metairie, LA (US)

(72) Inventor: Fred Francis Escher, Metairie, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/942,281

(22) Filed: Jul. 15, 2013

(65) Prior Publication Data

US 2015/0013584 A1 Jan. 15, 2015

Related U.S. Application Data

(63) Continuation of application No. 13/134,133, filed on May 31, 2011, now Pat. No. 8,522,705, which is a continuation-in-part of application No. 12/454,525, filed on May 19, 2009, now abandoned.

(60) Provisional application No. 61/128,250, filed on May 20, 2008.

(51) Int. Cl.
*B63B 35/44* (2006.01)
*B63H 21/17* (2006.01)

(52) U.S. Cl.
CPC ..... *B63B 35/44* (2013.01); *B63H 21/17* (2013.01)

(58) Field of Classification Search
CPC ..... B63B 1/12; B63B 1/121; B63B 35/28
USPC ..... 114/51, 61.14, 26, 61.1, 61.22
See application file for complete search history.

(56) References Cited

U.S. PATENT DOCUMENTS

| | | | | |
|---|---|---|---|---|
| 1,659,647 | A * | 2/1928 | Althouse | 114/51 |
| 5,199,912 | A * | 4/1993 | Dade et al. | 440/6 |
| 6,367,399 | B1 * | 4/2002 | Khachaturian | 114/61.1 |
| 7,040,244 | B1 * | 5/2006 | Ferran | 114/61.14 |
| 8,240,264 | B2 * | 8/2012 | Khachaturian | 114/51 |
| 8,522,705 | B2 * | 9/2013 | Escher | 114/51 |
| 8,701,579 | B2 * | 4/2014 | Roodenburg et al. | 114/61.14 |

* cited by examiner

*Primary Examiner* — Lars A Olson
*Assistant Examiner* — Jovon Hayes
(74) *Attorney, Agent, or Firm* — Keaty Law Firm, LLC

(57) ABSTRACT

A catamaran type vessel for use in a wastewater facility for servicing submerged air diffusers is disclosed. The vessel has spaced apart pontoon having an A-frame spanning between the upper decks of the pontoon and connecting the pontoons. A hook connected to a winch is secured to a cross header above the space between the pontoons. The hook is lowered into water and lifts an air header, to which the air diffusers are connected. An air diffuser is then pulled on the pontoons and serviced. The vessel is then propelled to a position to service other air diffusers in the pontoon.

7 Claims, 2 Drawing Sheets

FLOATING VESSEL FOR SERVICING AIR DIFFUSERS

CROSS-REFERENCE TO RELATED APPLICATIONS

This application is a continuation application of my application Ser. No. 13/134,133 filed on May 31, 2011 entitled "Floating Vessel for Servicing Air Diffusers," now U.S. Pat. No. 8,522,705 issued on Sep. 3, 2013, the full disclosure of which is incorporated by reference herein, and priority of which is hereby claimed.

BACKGROUND OF THE INVENTION

This invention relates to a floating vessel, specifically to an improved lifting barge adapted for servicing and maintaining submerged air diffusers in wastewater treatment facilities.

In the past, the only equipment a wastewater treatment facility used, to maintain and service submerged diffusers, was a flat boat. Three (3) men were needed to accomplish this task. Two (2) men would manually lift the air header and lay it on the boat while the third man would sit across from them steadying the boat, trying to keep it from tipping, taking on wastewater and sinking. This was an extremely unsafe method of working on the submerged diffusers and most workers declined to do this work.

The next method that came along was a pontoon boat that resembled a party barge. It had round flat-ended pontoons with a crane-hoist mounted to the bow. When in operation, the boat tilts forward from the weight of the air header, causing an unstable and uneven work platform for the workers. Also, due to the method of operation and its round pontoons with flat ends, which do not move through the water easily, it needs a large outboard motor to maneuver in the basin.

The present invention contemplates elimination of drawbacks associated with the conventional service boats and provision of a lifting barge, from which the air diffusers can be safely and conveniently serviced.

SUMMARY OF THE INVENTION

It is, therefore, an object of the present invention to provide a floating vessel for servicing submerged articles, such as air diffusers in wastewater treatment plant.

It is another object of the invention to provide a lifting barge that can safely accommodate the servicing personnel during the air diffusers maintenance.

It is another object of the invention to provide a lifting barge that can retain the air diffuser assembly within easy reach of the service personnel on the barge.

It is a further object of the invention to provide a self-propelled floating vessel suitable for use at a wastewater treatment facility.

These and other objects of the invention are achieved through a provision of a floating vessel for use in a wastewater plant when servicing submerged air diffusers. The vessel can be a catamaran-type vessel or barge. The service vessel has a pair of elongated floatable spaced apart pontoons, each pontoon having an upper deck. The pontoons can be formed from lightweight aluminum. A frame assembly extends upwardly from upper decks of said pontoons, spanning between the pontoons and connecting the pontoon in a catamaran fashion. The frame assembly comprises a generally A-shaped forward frame section, a generally A-shaped aft frame section, and a cross header connected to upper ends of the forward frame section and the aft frame section.

A lifting assembly is secured on the cross header such that the lifting assembly extends above the space between the two pontoons. A railing assembly is secured to the frame assembly and mounted on the upper deck of each of the pontoons. The railing assembly comprises a support plate, which extends along an inner edge of the pontoon and is configured for supporting an air diffuser during servicing. A top surface of the support plate is formed with increased friction characteristics to help retain a wet air diffuser on the vessel during servicing.

A railing assembly is mounted on the upper decks of each pontoon to form an enclosed area and prevent small objects from sliding off the decks during the vessel operation. A handrail is connected to deck-mounted rails for safety. In one aspect of the invention, the railing assembly is secured to the frame assembly, thus offering further stability to the vessel.

The vessel can be propelled by a motor connected to a battery. The battery can be recharged by a solar panel, if desired. During operation, the vessel is propelled in the wastewater lagoon to a position where the air header is located between the pontoons. The winch is activated to lift the air header and in turn lift one of the air diffusers on the support plates of the adjacent pontoons. After servicing, the air diffuser is lowered back into water, and the vessel is propelled to a position for servicing other air diffusers.

BRIEF DESCRIPTION OF THE DRAWINGS

Reference will now be made to the drawings, wherein like parts are designated like numerals, and wherein.

DETAIL DESCRIPTION OF THE INVENTION

Figure 1:
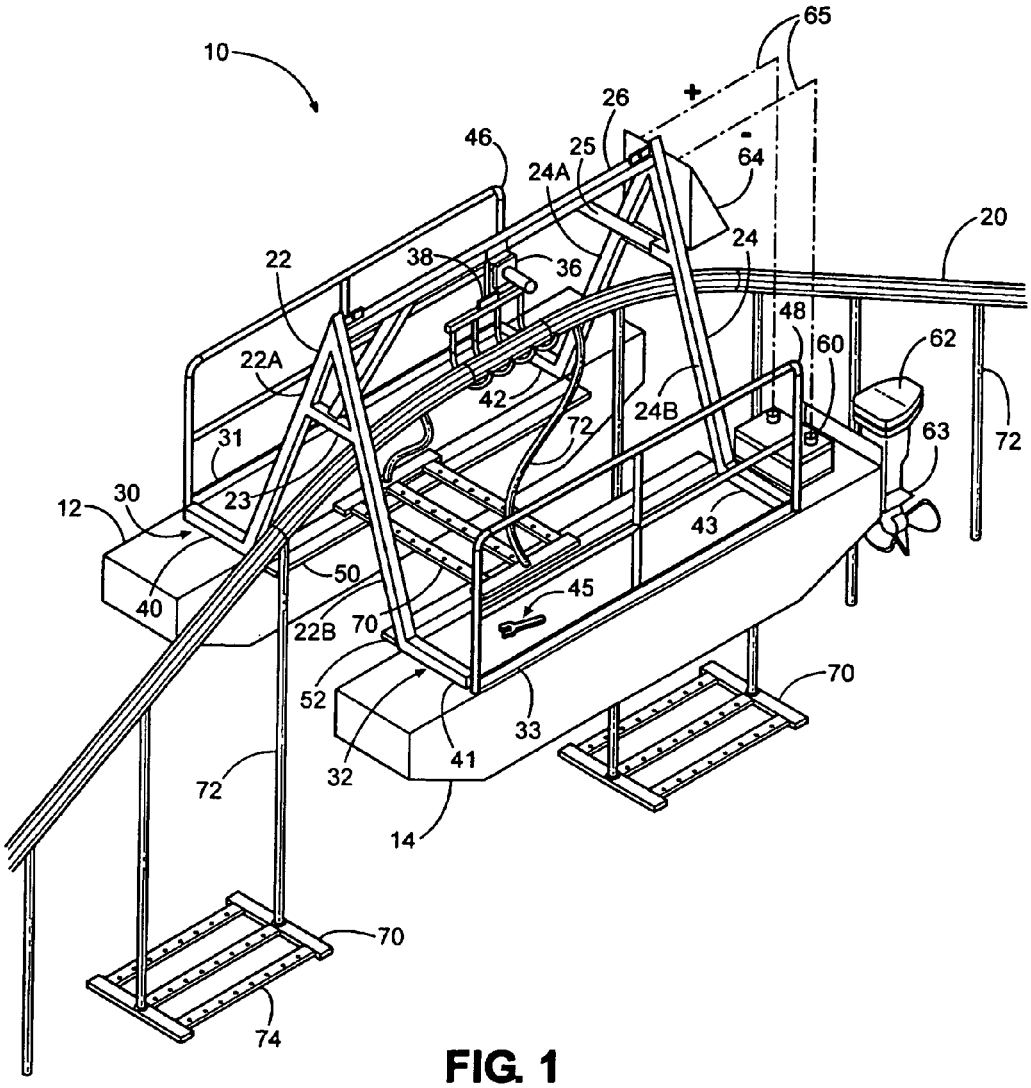
FIG. 1 is a perspective view of the floating vessel according to the present invention.
Figure 2:
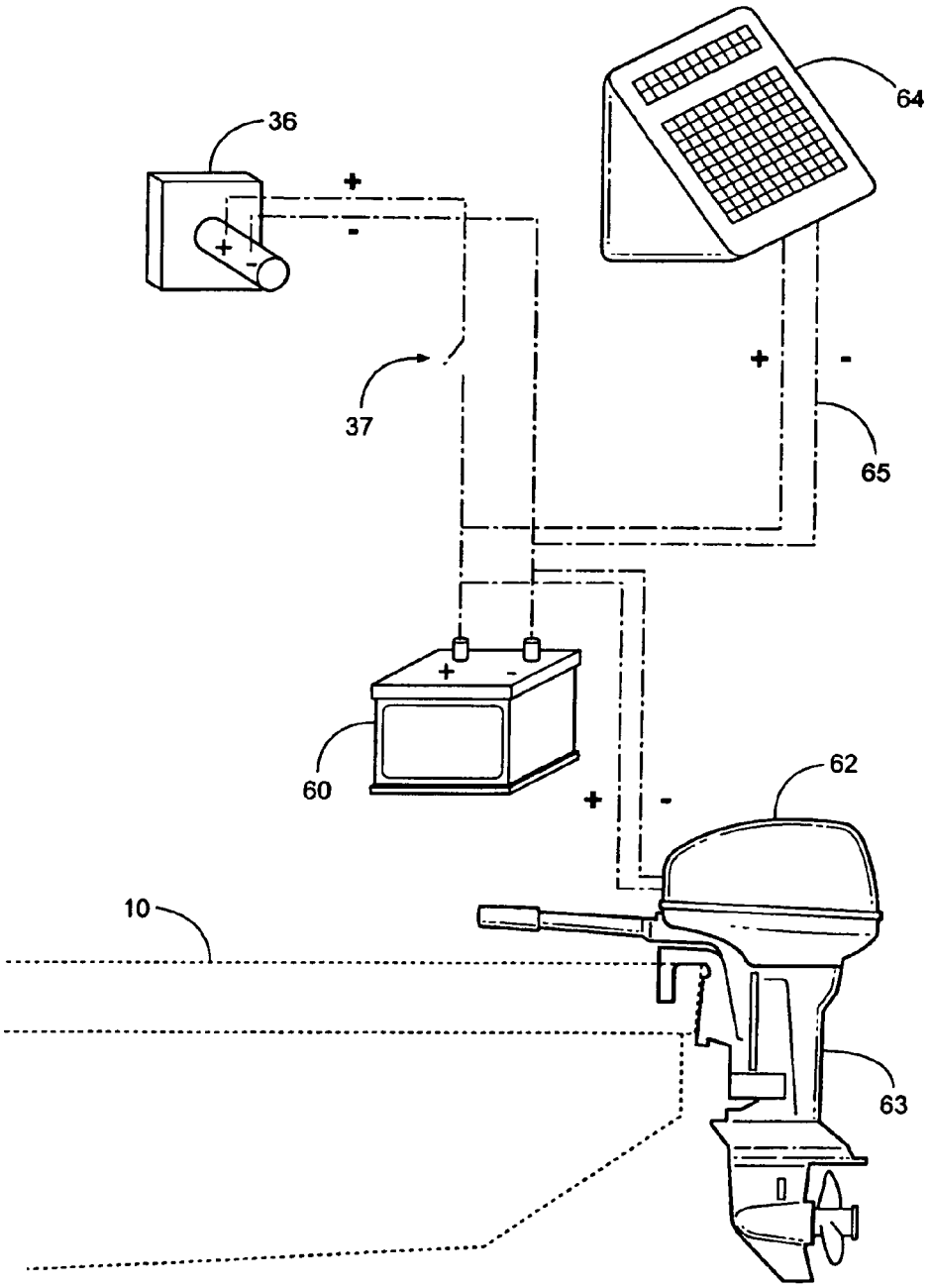
FIG. 2 is a schematic view of the electrical components utilized in the floating vessel of the present invention.

Turning now to the drawings in more detail, numeral 10 designates the floating vessel according to the present invention. The vessel 10 has a generally catamaran-type structure. The vessel 10 comprises a pair of spaced apart buoyant hulls 12 and 14. The hulls 12, 14 can be barges or any other buoyant bodies. The hulls 12 and 14 can be elongated pontoons having a generally square cross section in the center and slope-ended forward and aft portions. The pontoons 12 and 14 (sloped for ease of movement in the wastewater) can be constructed of ⅛" thick aluminum plate but could also be constructed of a thicker plate if so desired for added strength and longevity.

A frame assembly 16 spans between the hulls 12, 14. The frame 16 extends upwardly in a generally A-shape that provides space under the frame and in between the hulls for enabling air diffusers to be positioned in between the hulls and under the frame 16. The space in between the hulls 12, 14 and under the frame 16 can also be used as clearance for elevating a submerged object, such as an air header 20 to a position above the water's surface.

The frame 16 comprises a forward section 22 and an aft section 24 connected by a center beam or cross header 26 secured to apexes of the forward and aft section. Each of the forward and aft sections 22, 24 comprises an upwardly extending pair of trusses 22*a*, 22*b* and 24*a*, 24*b*, respectively. The forward trusses 22*a* and 22*b* form the forward section 22, while the aft section 24 is formed by angularly upwardly extending pair of trusses 24*a* and 24*b*.

A reinforcing cross member 23 is secured between the trusses 22*a* and 22*b* a distance from an apex where the trusses 22*a* and 22*b* connect. A similar reinforcing truss member 25 is secured between the trusses 24*a* and 24*b* adjacent the apex where the trusses 24*a* and 24*b* connect. The trusses 22*a*, 22*b* and cross member 23 form an A-shaped forward frame section, while the trusses 24*a*, 24*b* and cross member 25 form an A-shaped aft frame section.

In one of the preferred embodiments, the lower ends of the forward section 22 and the aft section 24 are welded to deck railing assemblies 30 and 32, respectively. Alternatively, the frame 16 can be bolted to the railing assemblies 30, 32. The A frame hoist structure 16 can be constructed of 3" square aluminum tubing.

A lifting assembly comprising a winch 36 and a hook device 38 is firmly attached to the center beam 26 in a center position along the length of the center beam 26. The winch 36 comprises a spool of cable; the cable is extended and retracted on the spool upon demand. The hook device, such as a grapple hook 38 is attached to the winch 36 cable allowing the operators to raise and lower the air header 20 between a submerged position and to a position above the water surface.

The railing assemblies 30, 32 each comprise a raised railing structure secured to the top deck of the pontoons 12 and 14. The starboard railing assembly 30 and the port railing assembly 32 comprise deck-mounted outside elongated rails 31, 33, which extend along the length of the pontoons adjacent their outer edges. The railing assemblies 30, 32 also comprise forward and aft cross members 40, 41, 42, and 43 which are affixed to extend transversely to the longitudinal axes of the outside rails 31, 33. The outside rails 31, 33 and the cross rails 40, 41, 42, and 43 form a protection area for small objects, such as hand tools 45 and prevent them from sliding off the decks of the pontoon during operation of the vessel 10.

Handrails 46 and 48 are secured to the deck railing members, extending upwardly therefrom in a generally parallel relationship to the outside rails and above the outside rails 31, 33. In one aspect of the invention, the railing assembly is secured to the frame assembly, thus offering further stability to the vessel.

The starboard pontoon 12 and the port pontoon 14 carry support plates 50 and 52, each of which is secured to its respective pontoon and extends along an inner edge thereof, generally parallel to the outside rail. At least a portion of the support plate is cantilevered from the inner edge of the hull. The support plates 50, 52 are preferably formed with a friction top surface so as to prevent the air diffusers 70 from sliding off the vessel 10 during servicing. In one aspect the support plates 50 and 52 can be formed from wood, aluminum, fiberglass and the like. The support plates 50, 52 extend in a generally parallel orientation to the inner edges of the respective pontoons and to the outside rails 31, 33.

A power source, such as a battery 60 is mounted on the deck of the port pontoon 14 in the aft portion thereof. The battery 60 powers the winch 36 and a motor 62, to which it is operationally connected. The motor 62 is provided with a propeller 63 to facilitate propulsion of the vessel 10 in water. A solar panel 64 is mounted on the truss 24 to generate electrical power and recharge the battery 60. Suitable wires 65 connect the solar panel with the battery 60. The battery 60 can be a conventional rechargeable 12-volt battery. Of course other types of power source can be employed in the vessel of the present invention.

In operation, the vessel 10 is placed into the aeration lagoon or basin of a wastewater treatment plant. The aeration lagoon has a plurality of air headers 20 positioned on the water surface. The air headers 20 are fluidly connected to submerged air diffusers 70 by hoses 72, which carry air below the water surface. The diffusers 70 have perforated tubes 74, through which the air is forced into the wastewater body. Diffusers are typically connected to piping through the headers 20, which is supplied with pressurized air by a blower (not shown).

The aeration grid in the wastewater plant requires continuous monitoring and servicing. The diffusers 70 need to be regularly inspected to make sure that the openings in the tubes 74 are not clogged with debris. To achieve this goal, the vessel 10 is propelled to a specified location in the lagoon such that the header 20 is positioned between the pontoons 12 and 14. The operator then activates a switch 37 of the winch 36 and lowers the grapple hook into the water. The operator then maneuvers the grapple hook device 38 to raise the air header above the water surface to a position shown in FIG. 1.

As the air header 20 is lifted, one or more of the air diffusers 70 are lifted from their submerge position. The operator then pulls an air diffuser 70 and positions it on the support plates 50, 52, as shown in FIG. 1. The air diffusers is then serviced and lowered back into the water in the space between the pontoons 12 and 14. The motor is energized and the vessel is propelled to another position from which another air diffuser can be retrieved for servicing. After servicing the diffusers, the winch 36 is activated in the down mode to lower the diffusers 70 and the air header 20 back into the wastewater. The above process is then repeated over again until servicing of the diffusers that need to be maintained is completed.

From the description above, a number of advantages of the vessel 10 become evident. Some of these advantages are in the shape of the hulls 12 and 14—the square pontoons offer greater stability then round pontoons and prevent the barge from rolling port to starboard. The winch 36, being placed in a center top position prevents tilting from bow to stern. The sloped ends on the square pontoons allow the barge to move smoothly through the wastewater with little effort. The A frame construction gives rigid support to the vessel when lifting the air header and, together with the center lift position, makes the vessel 10 very stable in operating conditions. The self-propelled feature saves time and labor allowing one or two operators to service many diffusers. The deck railing offers stability to the workers, while preventing small items from sliding off the deck. Many other advantages will become apparent to persons skilled in the art.

The vessel of the present invention can be used in other situations, as well, such as for instance search and rescue operations, when lifting items or people from water. The vessel can be propelled to the desired location and the winch can be reinforced to lift various loads.

Many changes and modifications can be made in the design of the present invention without departing from the spirit thereof. Thus the scope of the embodiments should be determined by the appended claims rather then by the examples given.

I claim:

1. A floating vessel, comprising:

a pair of floatable spaced apart hulls, each hull having an upper deck;

a frame assembly extending upwardly from upper decks of said hulls and spanning between the hulls, said frame assembly comprising a generally A-shaped forward frame section and an A-shaped aft frame section, each of said forward frame section and said aft frame section having a lower end, which rests on the upper decks of said hulls;

a deck railing assembly secured to lower ends of the forward frame section and the aft frame section of the frame assembly and mounted on the upper deck of each of the hulls; and a power means for propelling the vessel in water secured to at least one of said hulls.

2. The vessel of claim 1, wherein the power means comprises a rechargeable battery and a motor with a propeller operationally coupled to the battery.

3. The vessel of claim 1, wherein the vessel is a catamaran-shaped vessel.

4. The vessel of claim 1, wherein the vessel is a barge.

5. The vessel of claim 1, wherein the forward frame section and the aft frame section are structurally connected at their respective apexes.

6. The vessel of claim 1, wherein a center beam extends between apexes of the forward frame section and the aft frame section.

7. The apparatus of claim 6, wherein a hoisting assembly is suspended on said center beam.

* * * * *